US010958006B2

(12) United States Patent
Leidner et al.

(10) Patent No.: US 10,958,006 B2
(45) Date of Patent: Mar. 23, 2021

(54) CONTACT ELEMENT AND METHOD FOR PRODUCTION THEREOF

(71) Applicant: TE Connectivity Germany GmbH, Bensheim (DE)

(72) Inventors: Michael Leidner, Lambrecht (DE); Helge Schmidt, Speyer (DE); Stefan Thoss, Worms (DE)

(73) Assignee: TE Connectivity Germany GmbH, Bensheim (DE)

( * ) Notice: Subject to any disclaimer, the term of this patent is extended or adjusted under 35 U.S.C. 154(b) by 29 days.

(21) Appl. No.: 16/203,791

(22) Filed: Nov. 29, 2018

(65) Prior Publication Data

US 2019/0097342 A1 Mar. 28, 2019

Related U.S. Application Data

(63) Continuation of application No. PCT/EP2017/063389, filed on Jun. 1, 2017.

(30) Foreign Application Priority Data

Jun. 2, 2016 (EP) ..... 16172753

(51) Int. Cl.
*H01R 13/03* (2006.01)
*H01R 43/16* (2006.01)
*H01R 4/58* (2006.01)

(52) U.S. Cl.
CPC ..... *H01R 13/03* (2013.01); *H01R 43/16* (2013.01); *H01R 4/58* (2013.01); *Y10S 439/931* (2013.01)

(58) Field of Classification Search
CPC ..... H01R 13/03; H01R 4/58; H01R 43/16; Y10S 439/931
See application file for complete search history.

(56) References Cited

U.S. PATENT DOCUMENTS 4,687,274 A * 8/1987 Suh ..... H01R 11/01 439/426
6,238,971 B1 * 5/2001 Parekh ..... H01L 27/10888 257/E21.013
6,261,964 B1 * 7/2001 Wu ..... H01L 21/2815 257/E21.011

(Continued)

FOREIGN PATENT DOCUMENTS

CN 102402082 A 4/2012
CN 102623392 A 8/2012

(Continued)

OTHER PUBLICATIONS

Chinese First Office Action with English translation, Chinese Patent Application No. 201780033072.8, dated Aug. 26, 2019, 16 pages.

(Continued)

*Primary Examiner* — Tho D Ta
(74) *Attorney, Agent, or Firm* — Barley Snyder

(57) ABSTRACT

A contact element comprises an electrically conductive layer and a masking layer. A contact side of the contact element is at least partly covered by the masking layer and the electrically conductive layer. The electrically conductive layer and the masking layer form a contact surface having alternating regions of the masking layer and the electrically conductive layer.

17 Claims, 3 Drawing Sheets

(56) References Cited

U.S. PATENT DOCUMENTS

| | | | | |
|---|---|---|---|---|
| 7,063,896 | B2 * | 6/2006 | Mucklich | C22F 3/00 148/525 |
| 8,772,908 | B2 | 7/2014 | Haba | |
| 8,778,790 | B2 | 7/2014 | Maitani et al. | |
| 9,590,341 | B2 | 3/2017 | Sunaga et al. | |
| 9,917,112 | B2 | 3/2018 | Yamazaki et al. | |
| 10,193,021 | B2 | 1/2019 | Togawa et al. | |
| 2002/0008966 | A1 * | 1/2002 | Fjelstad | G01R 1/0466 361/760 |
| 2002/0115293 | A1 * | 8/2002 | Ghodsian | G01N 27/44721 438/689 |
| 2006/0162287 | A1 * | 7/2006 | Hasegawa | H01R 11/01 53/362 |
| 2012/0119367 | A1 | 5/2012 | Haba | |
| 2013/0014979 | A1 * | 1/2013 | Uzoh | H01R 13/03 174/257 |
| 2015/0236439 | A1 * | 8/2015 | Okubo | H01R 13/03 439/886 |
| 2015/0280339 | A1 * | 10/2015 | Saka | C25D 7/00 439/886 |
| 2015/0357737 | A1 | 12/2015 | Sunaga et al. | |

FOREIGN PATENT DOCUMENTS

| | | | |
|---|---|---|---|
| CN | 103299419 | A | 9/2013 |
| JP | S5569186 | A | 5/1980 |
| JP | 200021546 | A | 1/2000 |
| JP | 2001216773 | A | 8/2001 |
| JP | 2004315941 | A | 11/2004 |
| JP | 2008-300359 | A | 12/2008 |
| JP | 200959479 | A | 3/2009 |
| JP | 2014503992 | A | 2/2014 |
| JP | 2014135191 | A | 7/2014 |
| JP | 2016178268 | A | 10/2016 |

OTHER PUBLICATIONS

Abstract of JP 2008-300359 A, dated Dec. 11, 2008, 1 page.
PCT Notification, International Search Report and Written Opinion of the International Searching Authority, dated Aug. 28, 2017, 13 pages.
Abstract of JP 2004315941, dated Nov. 11, 2004, 1 page.
Chinese Second Office Action and English translation, App No. 201780033072.8, dated Mar. 16, 2020, 7 pages.
Japanese Office Action and English translation, dated Jun. 16, 2020, 7 pages.
Japanese Office Action, dated Nov. 12, 2019, 18 pages.

* cited by examiner

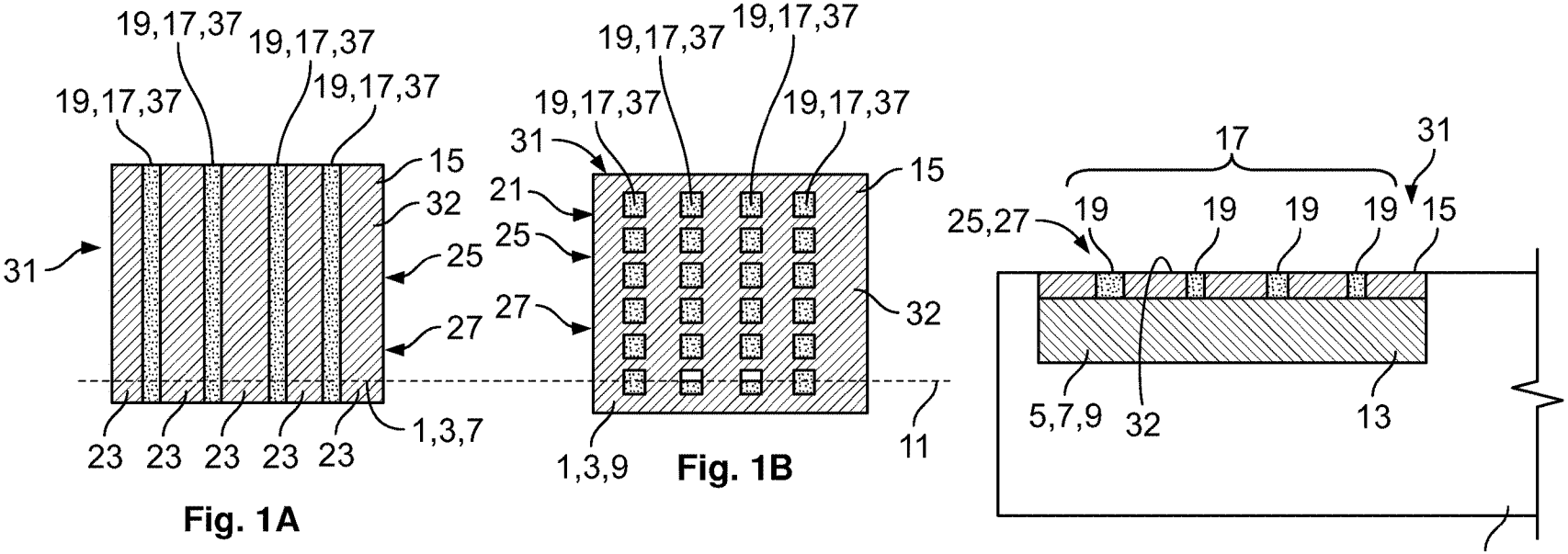
Fig. 1C
Fig. 1B
Fig. 1A
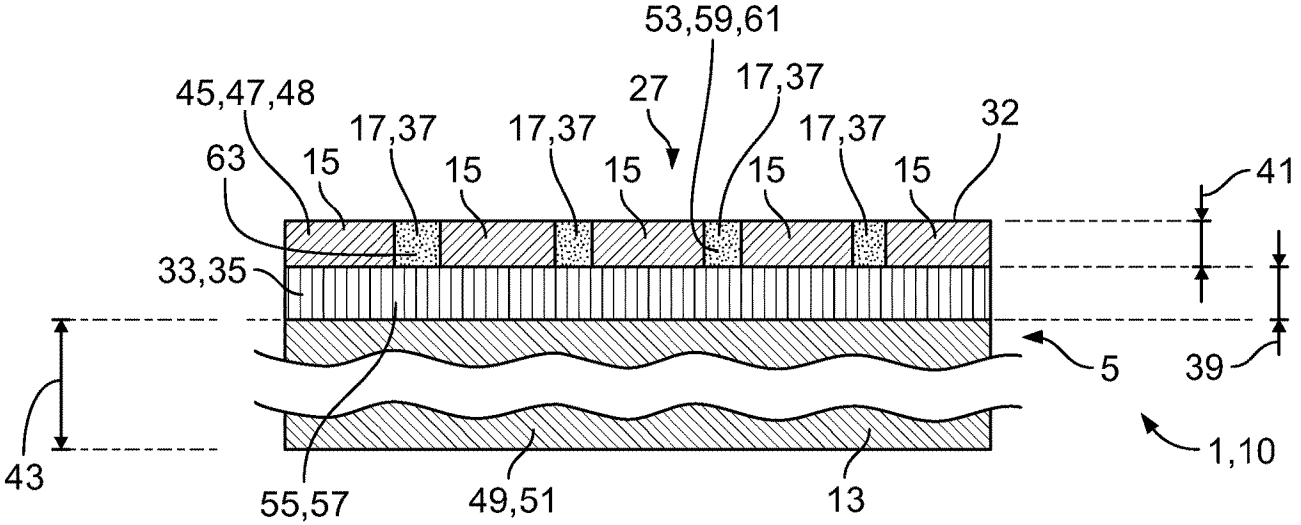
Fig. 2

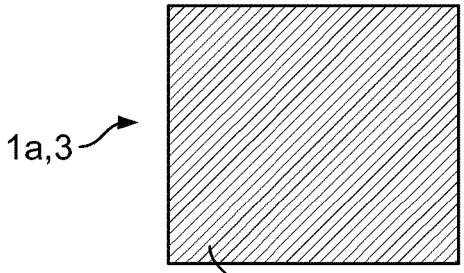
Fig. 4A
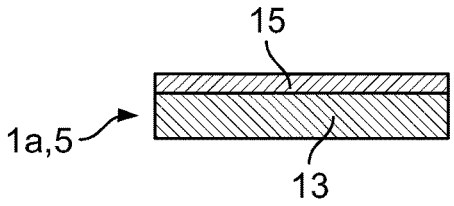
Fig. 4B
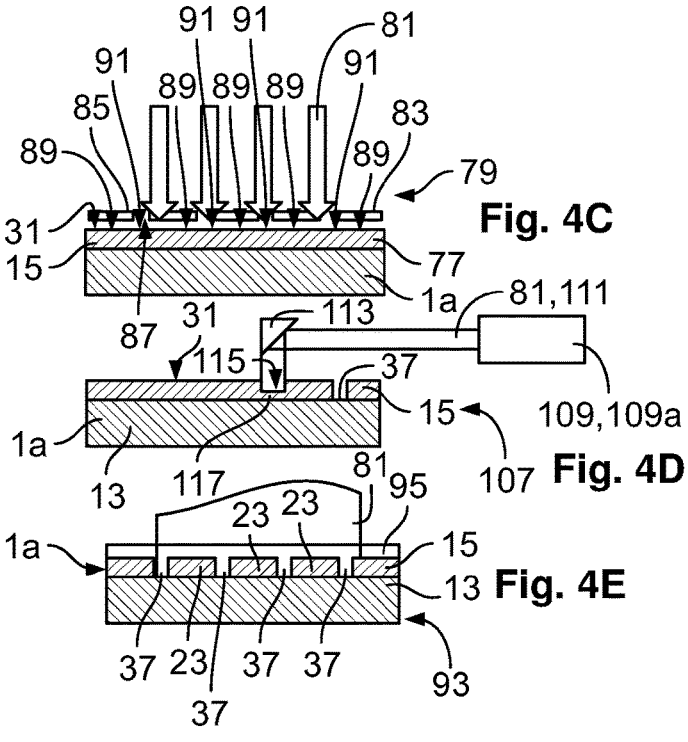
Fig. 4C
Fig. 4D
Fig. 4E
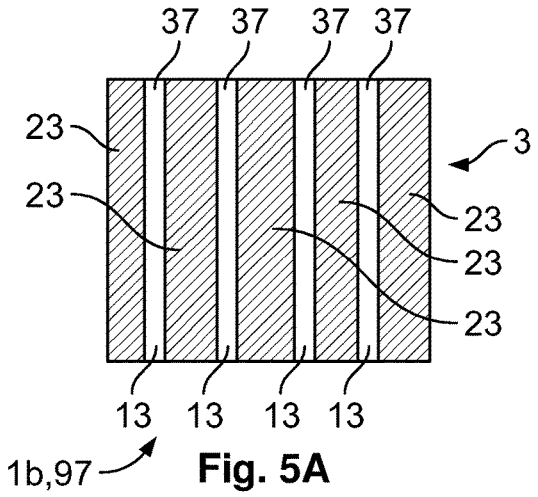
Fig. 5A
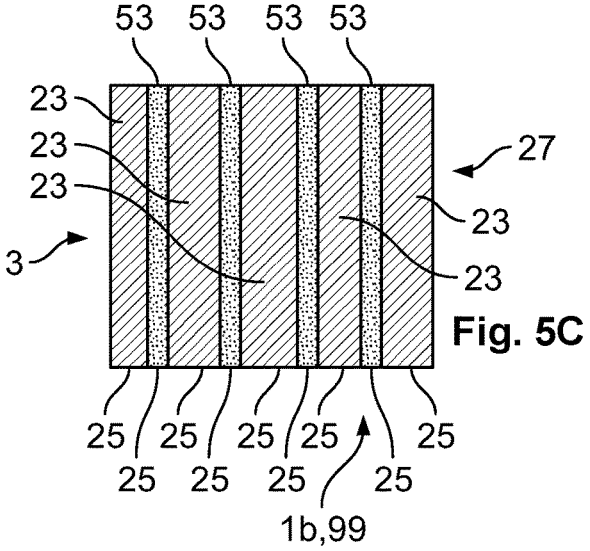
Fig. 5C
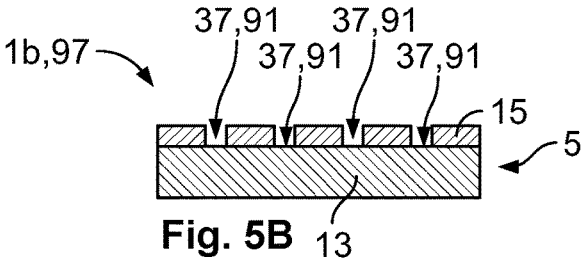
Fig. 5B
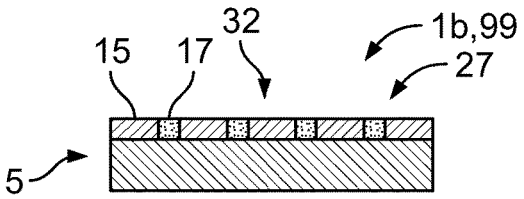
Fig. 5D

CONTACT ELEMENT AND METHOD FOR PRODUCTION THEREOF

CROSS-REFERENCE TO RELATED APPLICATIONS

This application is a continuation of PCT International Application No. PCT/EP 2017/063389, filed on Jun. 1, 2017, which claims priority under 35 U.S.C. § 119 to European Patent Application No. 16172753.2, filed on Jun. 2, 2016.

FIELD OF THE INVENTION

The present invention relates to a contact element and, more particularly, to a contact element having an electrically conductive layer and a masking layer.

BACKGROUND

Contact elements for electric plug connectors have high plug-in forces, which result in wear of the contact element, especially if relative movements between the contact element and a counter contact element occur. In miniaturized plug connectors and in plug connectors having a plurality of contact elements, such as contact pins, the necessary plug-in forces for obtaining a final plug state of the plug connector are high. Contact surfaces of the plug connectors have limited wear resistance and are generally stationary contact surfaces for which a necessary plug-in force increases as a number of contact elements increases.

Lubrication can be applied to the contact elements or mechanical assistance such as levers can be used to lower the plug-in forces necessary to reach the final plug state. Mechanical assistance, however, renders the plug connector more complicated and more expensive, while lubrication must also meet requirements for shelf life and temperature stability.

Contact elements can have noble metals, such as gold, silver, palladium, or tin, on an entire contact surface of the contact element. These metal coatings increase the resistivity of the contact element against corrosion without remarkably reducing the electric conductivity of the contact element. These noble metals, however, are precious metals and increase the cost of the plug connectors.

SUMMARY

A contact element comprises an electrically conductive layer and a masking layer. A contact side of the contact element is at least partly covered by the masking layer and the electrically conductive layer. The electrically conductive layer and the masking layer form a contact surface having alternating regions of the masking layer and the electrically conductive layer.

BRIEF DESCRIPTION OF THE DRAWINGS

The invention will now be described by way of example with reference to the accompanying Figures, of which:

FIG. 1A is a top view of a contact element according to an embodiment;

FIG. 1B is a top view of a contact element according to another embodiment;

FIG. 1C is a sectional side view of the contact elements of FIGS. 1A and 1B;

FIG. 2 is a sectional side view of a contact element according to another embodiment;

FIG. 4A is a top view of a pretreated contact element;

FIG. 4B is a sectional side view of the pretreated contact element of FIG. 4A;

FIG. 4C is a sectional side view of a photochemical treatment for removing parts of the masking layer;

FIG. 4D is a sectional side view of a laser ablation technique for removing parts of the masking layer;

FIG. 4E is a sectional side view of a displacement treatment for removing parts of the masking layer;

FIG. 5A is a top view of a structured contact element in a pre-disposition state;

FIG. 5B is a sectional side view of the structured contact element in the pre-disposition state;

FIG. 5C is a top view of the structured contact element in a final state; and FIG. 5D is a sectional side view of the structured contact element in the final state.

DETAILED DESCRIPTION OF THE EMBODIMENT(S)

Figure 3C:
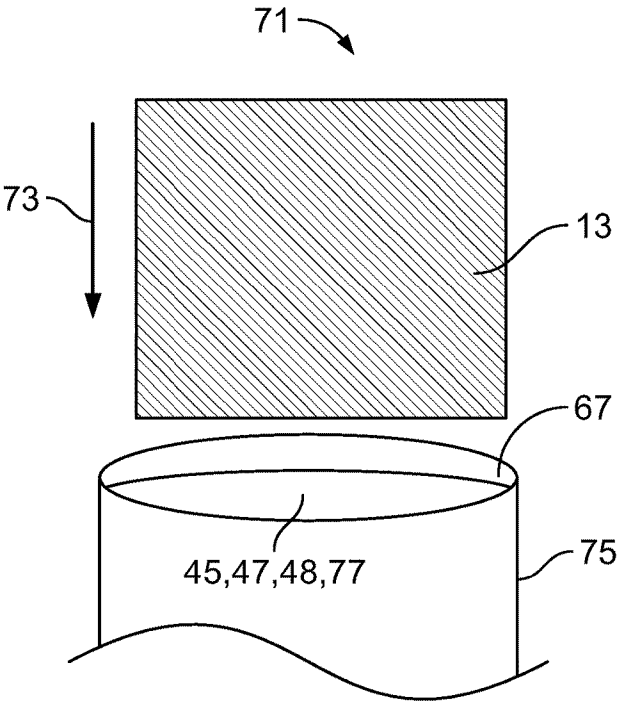
FIG. 3C is a top view of a dipping technique of masking the substrate with the masking layer.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will be thorough and complete and will fully convey the concept of the disclosure to those skilled in the art.

A first embodiment 7 and a second embodiment 9 of a contact element 1 are shown in a top view 3 and a sectional side view 5 in FIGS. 1A-1C. The sectional side view 5 of FIG. 1C corresponds to the first embodiment 7 and the second embodiment 9, both cutting along a line 11 in the top views 3 of FIGS. 1A and 1B. The contact element 1 has a substrate 13, a masking layer 15, and an electrically conductive layer 17 as shown in FIG. 1C.

The electrically conductive layer 17 includes a plurality of portions 19 constituting the electrically conductive layer 17. The portions 19 of the electrically conductive layer 17 correspond to unmasked regions 37. In the first embodiment 7 shown in FIGS. 1A and 1C, the portions 19 are stripe-shaped. In the second embodiment 9, shown in FIGS. 1B and 1C, the portions 19 are rectangular shaped and are arranged in a matrix 21 of six by four. The stripe-shaped portions 19 separate the masking layer 15 of the first embodiment 7 into stripe-shaped portions of the masking layer 23, whereas the second embodiment 9 of the contact element 1 includes one unitary masking layer 15 interrupted by the rectangular portions of the electrically conductive layer 19.

As shown in FIG. 1C, the masking layer 15 and the electrically conductive layer 17 are directly deposited on the substrate 13 and both layers 15, 17 form alternating regions 25. The alternating regions 25 generate a contact pattern 27 that is symmetric in the embodiments shown in FIGS. 1A-1C, but may also be asymmetric in other embodiments and consist of an arbitrary number of portions 19 and an arbitrary number of portions of the masking layer 23 in an arbitrary shape.

In the embodiments of FIGS. 1A-1C, the contact elements 1 have a contact side 31 on which the masking layer 15 and electrically conductive layer 17 are deposited on the substrate 13 to form a contact surface 32. The substrate 13 is entirely covered and protected by the masking layer 15 and the electrically conductive layer 17. As shown in FIG. 1C, the contact elements 1 may be part of an electric assembly 29.

A third embodiment 10 of the contact element 1 is shown in a sectional side view 5 in FIG. 2. Like reference numbers refer to like elements and only the differences from the embodiments 7, 9 described above with reference to FIGS. 1A-1C will be described in greater detail herein.

In the third embodiment 10, as shown in FIG. 2, the contact element 1 includes an intermediate layer 33 embodied as a nickel or nickel alloy layer 35. The intermediate layer 33 is disposed between the substrate 13 and the masking layer 15 and between the substrate 13 and the electrically conductive layer 17. The intermediate layer 33 may be deposited by galvanic deposition, chemical or physical vapor deposition, ion beam deposition, sputtering or similar techniques. The intermediate layer 33 has a first layer thickness 39 which is similar to a second layer thickness 41 of the masking layer 15 and the electrically conductive layer 17. Each of the first layer thickness 39 and the second layer thickness 41 is smaller than a substrate thickness 43 of the substrate 13. In an embodiment, each of the first layer thickness 39 and the second layer thickness 41 is approximately 1 μm up to 100 μm. In an embodiment, the first layer thickness 39 is approximately 1 μm and approximately 3 μm.

The masking layer 15, in the third embodiment 10 shown in FIG. 2, contains a polymer 45. The polymer 45 includes a lubricating filler medium 47 and/or an electrically conductive filler medium 48. In an embodiment, the lubricating filler medium 47 has a long shelf life and the masking layer 15 having the lubricating filler medium 47 provides lubrication to the electrically conductive layer 17. The lubricating filler medium 47 may be a wet or a dry lubricant, such as grease or graphite. The lubricating filler medium 47 may comprise lubricating particles immersed in the material of the masking layer 15. The electrically conductive filler medium 48 may comprise particles or nanoparticles, for instance, carbon derivates like graphite or nanotubes, or simply metal particles.

The polymer 45 used for the masking layer 15 may be designed for different applications, for instance, for different temperature ranges in which the contact element 1 may be applied as well as ambient conditions like humidity, electromagnetic radiation, or atmosphere. The polymer 45 may be any commercially available polymer, such as PMMA, PE, PVC, PET, PC, PET, PU or similar, suitable for receiving the lubricating filler medium 47.

The electrically conductive filler medium 48 and/or the lubricating filler medium 47 may be provided in the polymer 45 prior to masking of the substrate 13 with the masking layer 15. In another embodiment, the electrically conductive filler medium 48 and/or the lubricating filler medium 47 may be incorporated into the masking layer 15 after masking the substrate 13 with the masking layer 15. Incorporation of said filler media 47, 48 may be performed by assimilation, implantation, absorption or adsorption. The filler media 47, 48 may be homogeneously provided in the masking layer 15 or solely in a top portion of the masking layer 15, wherein the top portion is to be understood as the part of the masking layer farthest away from the substrate 13.

The substrate 13 is made of copper 49 or a copper alloy 51. Copper or a copper alloy yield low ohmic resistance, a high electric conductivity, and may be easily manufactured, however, copper shows the tendency of oxidation in ambient air and is, due to its hardness, not suitable for repeated plug-in operations. The copper or copper alloy of the substrate 13 is therefore at least partly covered by the masking layer 15 and the electrically conductive layer 17.

The portions 19 of the electrically conductive layer 17 contain a contact material 53 which is different than a material of the substrate 13. The contact material 53 of the electrically conductive layer 17 may be a noble metal 59 or tin 61. The noble metal 59 may be gold, silver, palladium, or a less toxic heavy metal such as tin 61. A copper alloy of different composition than the substrate 13 may be used as material for the electrically conductive layer 17. The material of the intermediate layer 33, in the shown embodiment, contains nickel 55 or a nickel alloy 57. Application of nickel 55 or nickel alloy 57 as the intermediate layer 33 increases the effective hardness 63 of the electrically conductive layer 17.

The contact surface 32 mechanically abuts a counter contact surface during a plug-in operation. The masking layer 15 is in mechanical contact with the counter contact surface, but the contact force is exerted through the portions 19 of the electrically conductive layer 17. The material of the masking layer 15 including the lubricating filler medium 47 is not displaced by the counter contact surface but is still in mechanical contact with it. The masking layer 15, with the polymer 45 as described above, can therefore lubricate the contact surface 32 for reducing the plug-in forces and provide an additional electrical connection with the counter contact surface.

A process for forming the contact element 1 shown in the embodiments 7 and 9 in FIGS. 1A-1C includes a step of masking the substrate 13 with the masking layer 15, forming at least one unmasked region 37 by partially removing the masking layer 15, and depositing a conductive layer 17 in at least part of the at least one unmasked region 37.

Figure 3A:
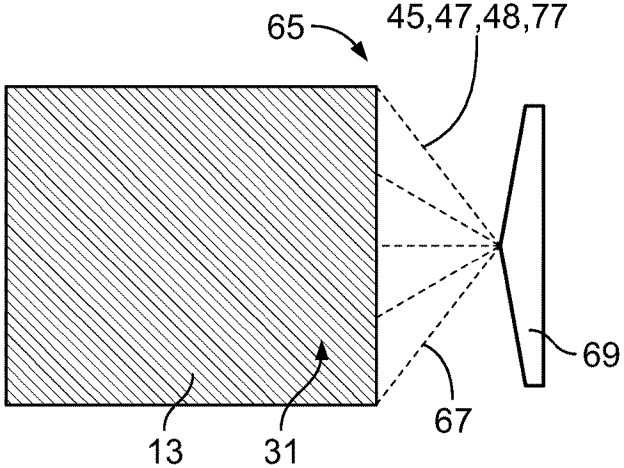
FIG. 3A is a top view of a spraying technique of masking a substrate with a masking layer.
Figure 3B:
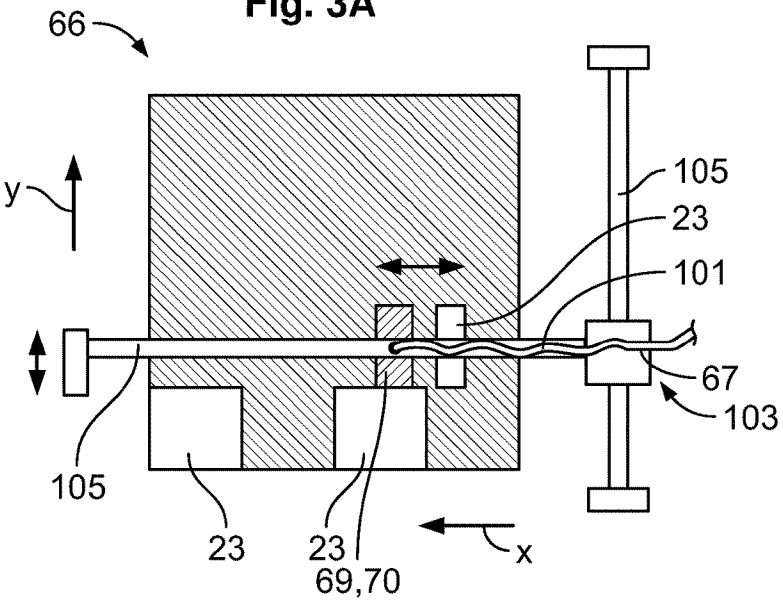
FIG. 3B is a top view of a printing technique of masking the substrate with the masking layer.

FIGS. 3A-3C show three techniques for masking the substrate 13 with the masking layer 15.

In a spraying 65 technique, shown in FIG. 3A, a liquid masking material 67 is sprayed through a nozzle 69 onto the substrate 13. In the spraying 65, only the contact side 31 may be provided with the masking layer 15.

In a printing 66 technique, shown in FIG. 3B, the liquid masking material 67 is provided via a flexible tube 101 to a multitude of nozzles 69, embodied as printing nozzles 70, providing the liquid masking material 67 in a structured manner with a resolution of the structures depending on the size of the printing nozzle 70. A printing assembly 103 allows for movement of the printing nozzle 70 along an x-direction and a y-direction indicated by arrows in FIG. 3B. In FIG. 3B, the printing assembly 103 is shown after the generation of three portions of the masking layer 23. The printing assembly 103 is shown only schematically in FIG. 3B, and the translation device 105 allowing for movement of the printing nozzle 70 along the x-direction and along the y-direction may be embodied differently than shown. Possible printing 66 techniques for application of the masking layer 15 to the substrate 13 are, in various embodiments, ink jet printing, jet printing, or gravure printing. The printing 66 techniques may also be applied to print a homogenous masking layer 15 on the substrate 13.

The spraying 65 and printing 66 techniques are pressure based. In a dipping 71 technique, shown in FIG. 3C, the substrate 13 is moved along a direction 73 into the liquid masking material 67 disposed in a container for liquids 75. The technique of dipping 71 masks the entire substrate 13 moved into the liquid masking material 67. Spraying 65, on the other hand, may be used if the second layer thickness 41 is to be precisely controlled.

The liquid masking material 67 may, in dipping 71 or spraying 65, already contain the lubricating filler medium 47 and/or the electrically conductive filler medium 48 and/or a photosensitive filler medium 77 dissolved in the polymer 45 of the liquid masking material 67. The photosensitive filler medium 77 may contain or consists of a photoresist or a hardening polymer. The photosensitive filler medium 77 is to be understood as a material which changes its physical and/or mechanical and/or chemical properties upon illumination with light of a certain wavelength range. As a possible, non-limiting example, a photosensitive filler medium 77 may increase its resistivity against a chemical, such as decreasing its solubility in this chemical.

A pretreated contact element 1*a* after a processing step shown in FIGS. 3A-3C is shown in FIGS. 4A and 4B. FIG. 4A shows a top view 3 of the pretreated contact element 1*a* and FIG. 4B shows a sectional side view 5 of the pretreated contact element 1*a*. The pretreated contact element 1*a* shown in FIGS. 4A and 4B includes the substrate 13 and the masking layer 15.

Three possible techniques for removing parts of the masking layer 15 are shown in FIGS. 4C-4E.

FIG. 4C shows a photochemical treatment 79 technique for removing parts of the masking layer 15. In the photochemical treatment 79, the pretreated contract element 1*a* is illuminated on the contact side 31 by light 81 of a wavelength that alters the properties of the photosensitive filler medium 77 incorporated in the masking layer 15. The light 81 homogeneously illuminates a mask carrier 83 which includes opaque regions 85 and transparent regions 87. The transparent regions 87 may be embodied as through-holes in an embodiment of the mask carrier 83.

As shown in FIG. 4C, the opaque regions 85 of the mask carrier 83 form non-illuminated portions 89 on the contact side 31 located below the opaque regions 85 and illuminated portions 91 on the contact side 31 located below the transparent regions 87. Depending on the type of the photosensitive filler medium 77 (positive or negative), either the illuminated portions 91 or the non-illuminated portions 89 will be removed in a developing step to remove parts of the masking layer 15.

FIG. 4D shows a laser ablation 107 technique for removing parts of the masking layer 15 in which a laser 109 emits the light 81, a laser light 111, onto a scanning mirror device 113 which allows moving the laser light 111 in a scanning manner over the pre-treated contact element 1*a*. In an embodiment, the laser 109 is a pulsed laser 109*a*. Laser ablation 107 uses short or ultra-short pulses of laser light 111 with pulse durations in the ns-range or fs-range, as for instance emitted by solid state lasers based on rare earth doped laser active materials or titanium sapphire, respectively by excimer lasers. In another embodiment, the ablation can be conducted similarly by electron beam ablation.

The pulsed laser 109*a*, as shown in FIG. 4D, generates an unmasked region 37 and is shown in a state in which a portion of the masking layer 15 is partially ablated and forms a partially ablated portion 115. In the partially ablated portion 115, the masking layer 15 is partially removed on the contact side 31 and a residual fraction 117 of the masking layer still covers the substrate 13. The laser light 11 may have a small beam diameter, allowing for fine structures with a high resolution generated in the masking layer 15. The resolution may be further increased if an electron beam is applied instead of the laser 109.

FIG. 4E shows a displacement treatment 93 for removing parts of the masking layer 15 in which the pretreated contract element 1*a* is mechanically contacted by a displacement member 95. The displacement member 95 displaces the material of the masking layer 15 and generates unmasked regions 37 where the masking layer 15 is missing and the substrate 13 is exposed after the displacement member 95 is removed from the pretreated contact element 1*a*.

In the embodiment shown in FIG. 4E, the displacement member 95 is transparent and transmits the light 81. The displacement member 95 may be an embossing die. Only a limited area of the displacement member 95 is illuminated by the light 81. The light 81 is transmitted through the transparent displacement member 95 and reaches the portions of the masking layer 23 including the unmasked regions 37.

The displacement treatment 93 described with reference to FIG. 4E may be used if the material of the masking layer 15 has a low viscosity in order to allow for displacement of the masking layer 15 by the displacement member 95. The illumination of the remaining portions of the masking layer 23 initiate a hardening of the material of the masking layer 15. Such a hardening may be performed simultaneously with the displacement of the masking layer 15 by the displacement member 95.

A structured contact element 1*b* is shown in a predisposition state 97 in FIGS. 5A and 5B and in a final state 99 in FIGS. 5C and 5D. The pre-deposition state 97 is shown in a top view 3 in FIG. 5A and in a sectional side view 5 in FIG. 5B, while the final state 99 is shown in a top view 3 in FIG. 5C and a sectional side view 5 in FIG. 5D.

In the pre-deposition state 97, shown in FIGS. 5A and 5B, the illuminated portions 91 of the masking layer 15 have been removed. The pre-deposition state 97 may also be obtained by the displacement treatment 93 shown in FIG. 4E. The unmasked regions 37 are stripe-shaped and expose the substrate 13.

In the next fabrication step, a contact material 53 is deposited in between the portions of the masking layer 23, on the unmasked regions 37, and the contact material 53 is not deposited on the portions of the masking layer 23 to form the final state 99 shown in FIGS. 5C and 5D. After the deposition step, the masking layer 15 and the electrically conductive layer 17, which are composed of the corresponding portions 19, 23, form the alternating regions 25 and the contact pattern 27 of the corresponding contact element 1. As shown in FIG. 5C, the alternating regions 25 of the different portions 19, 23 form the even and uninterrupted contact surface 32.

What is claimed is:

1. A contact element, comprising:

an electrically conductive layer; and a masking layer selectively disposed on portions of a contact side of the contact element for defining masked regions and unmasked regions of the contact side, the electrically conductive layer selectively disposed in the unmasked regions for forming a contact surface having alternating regions of the masking layer and the electrically conductive layer.

2. The contact element of claim 1, wherein the masking layer includes a lubricating filler medium.

3. The contact element of claim 1, wherein the masking layer includes an electrically conductive filler medium.

4. The contact element of claim 1, wherein the electrically conductive layer is disposed only in the unmasked regions of the contact element.

5. The contact element of claim 1, wherein the contact side of the contact element comprises a generally planar surface on which the masking layer and electrically conductive layer are disposed.

6. The contact element of claim 1, further comprising a substrate on which each of the electrically conductive layer and the masking layer are directly disposed.

7. The contact element of claim 6, wherein a material of the substrate is copper or a copper alloy.

8. The contact element of claim 6, wherein a material of the electrically conductive layer is different from a material of the substrate.

9. The contact element of claim 1, further comprising:

a substrate; and an intermediate layer disposed between the substrate and at least one of the masking layer and the electrically conductive layer.

10. The contact element of claim 9, wherein the intermediate layer has a thickness between approximately 1 μm and approximately 3 μm.

11. The contact element of claim 9, wherein a material of the intermediate layer contains one of nickel or a nickel alloy.

12. A method for producing a contact element, comprising:

masking a substrate of the contact element with a masking layer;

forming an unmasked region by partially removing the masking layer without removing a corresponding portion of the substrate covered by the masking layer; and after the step of forming the unmasked region, depositing an electrically conductive layer in at least part of the unmasked region.

13. The method of claim 12, further comprising providing an intermediate layer between the substrate and at least one of the masking layer and the electrically conductive layer.

14. The method of claim 12, wherein the masking layer includes at least one of an electrically conductive filler medium and a lubricating filler medium.

15. The method of claim 12, wherein the forming step includes displacing parts of the masking layer with a displacement member.

16. The method of claim 12, wherein the masking layer includes a photosensitive filler medium.

17. The method of claim 16, wherein the forming step includes illuminating the masking layer and photochemically developing an illuminated portion or a non-illuminated portion of the masking layer for partial removal.

* * * * *